US011859366B1

(12) United States Patent
English

(10) Patent No.: US 11,859,366 B1
(45) Date of Patent: Jan. 2, 2024

(54) RETRACTABLE TOOTH BUCKET

(71) Applicant: Alex Scott English, Wailuku, HI (US)

(72) Inventor: Alex Scott English, Wailuku, HI (US)

( * ) Notice: Subject to any disclaimer, the term of this patent is extended or adjusted under 35 U.S.C. 154(b) by 163 days.

(21) Appl. No.: 17/512,476

(22) Filed: Oct. 27, 2021

(51) Int. Cl.
*E02F 3/96* (2006.01)
*E02F 9/28* (2006.01)
*E02F 3/40* (2006.01)

(52) U.S. Cl.
CPC ..... *E02F 3/963* (2013.01); *E02F 3/40* (2013.01); *E02F 9/2816* (2013.01)

(58) Field of Classification Search
CPC ... E02F 3/963; E02F 3/40; E02F 3/404; E02F 3/405; E02F 3/401; E02F 9/2816
USPC ..... 37/409, 447, 903
See application file for complete search history.

(56) References Cited

U.S. PATENT DOCUMENTS 2,899,760 A * 8/1959 Armington et al. .. E02F 3/8155 172/476
3,048,292 A * 8/1962 Kohorst ..... E02F 3/407 37/444
3,269,039 A * 8/1966 Bodiue ..... E02F 3/8155 414/375
3,305,953 A * 2/1967 Oswald ..... E02F 3/405 37/447
3,328,904 A * 7/1967 Voigt ..... E02F 3/405 37/447
4,512,090 A * 4/1985 Billings ..... E02F 3/815 37/405
4,729,180 A * 3/1988 Hendricks ..... E02F 9/2808 37/903
4,967,850 A * 11/1990 Bargfrede ..... F41H 11/24 172/197
5,546,650 A * 8/1996 Dee ..... G11B 5/313
8,069,591 B2 * 12/2011 Dunn ..... E02F 3/401 37/406
9,506,215 B2 * 11/2016 Krell ..... E02F 3/40
11,492,776 B1 * 11/2022 Antonelli ..... E02F 3/404
2008/0313934 A1 * 12/2008 Smoljo ..... E02F 3/8155 37/409

* cited by examiner

*Primary Examiner* — Thomas B Will
*Assistant Examiner* — Audrey L Lusk
(74) *Attorney, Agent, or Firm* — Plager Schack LLP; Mark H. Plager; Michael J. O'Brien

(57) ABSTRACT

A retractable tooth bucket configured to provide both digging and grading functionality on a worksite. The retractable tooth bucket has a bucket joined to a first bracket and a second bracket. A first pivot frame joined to the first bracket. A second pivot frame is joined to the second bracket. A first and second mounting brackets are joined to the bucket. A cylinder is joined to the hydraulic ram, and the first and second pivot frames. A hydraulic fluid line is joined to the hydraulic ram. Three cross members are joined to the first and second pivot frames. Five spines are joined to the third cross member and arranged against a pivot pin. Engaging the hydraulic ram causes spines to extend away from the bucket.

9 Claims, 7 Drawing Sheets

RETRACTABLE TOOTH BUCKET

BACKGROUND

The embodiments herein relate generally to construction equipment and civil engineering.

Excavation plays a major role in production. Excavation includes digging trenches and holes for utilities, grading out an area to build on, it also includes digging footers which is the base of the foundation which holds up every structure, building, bridge, etc. With this said here are some of the problems with using todays conventional excavator and/or back hoe digging buckets. When scooping material out of a semi or a dump truck, it is way more efficient to use a flat-bladed bucket. It also does less damage to the inside of the bed of the semi or dump truck, but in reality, nobody would take the time to switch out the toothed-bucket for a flat-bladed bucket. Another problem is when you are digging a footer with a toothed-bucket most of the time you are required to backfill with a compacted structural fill and it is way easier and way more accurate to use a flat-bladed bucket to grade out the structural so it can be compacted. The same goes for when bedding a trench or hole for a pipeline or utility box. But once again understandably, nobody takes the time to switch out the toothed-bucket for the flat-bladed bucket.

Instead, what most work crews do is the operator uses the bottom of the toothed-bucket and blindly tries to grade the fill as close as possible. Then a laborer jumps into the trench or hole to hand rake and fine tune the grade, and this takes time to do. Some machines are equipped with a hydraulic switch to assist with releasing the locking pin when changing out the buckets. For those machines without the hydraulic switch, it requires workers to remove the locking pin by using a sledge hammer to beat it out. This can be very dangerous and obviously it takes up valuable time. Machines that are equipped with a hydraulic switch still require the operator to fish the knuckle through and hook up to the pivot hinge and positioning the bucket correctly before the locking pin can be set with the switch, and this also takes time. Embodiments of the disclosed invention solve these problems.

SUMMARY

A retractable tooth bucket, is configured to provide both digging and grading functionality on a worksite. The retractable tooth bucket comprises a bucket joined to a pin with a first lock and a second lock. A first bracket and a second bracket are joined to the bucket. A first pivot frame is joined to the first bracket. A second pivot frame is joined to the second bracket. A first mounting bracket is joined to the bucket. A second mounting bracket is joined to the bucket. A hydraulic ram is joined to the first mounting bracket and the second mounting bracket with a hydraulic ram pin.

A support bracket is joined to the hydraulic ram and configured to provide support for the hydraulic ram. A cylinder is joined to the hydraulic ram, the first pivot frame, and the second pivot frame with a pivot frame pin. A hydraulic fluid line is joined to the hydraulic ram and to a quick connect. The hydraulic fluid line is representative of both supply and return lines.

A first cross member, and a second cross member, a third cross member, and a pivot pin are joined to the first pivot frame and the second pivot frame. A first spine, a second spine, a third spine, and a fourth spine joined to the third cross member and arranged against the pivot pin. A first tooth is joined to the first spine. A second tooth is joined to the second spine. A third tooth is joined to the third spine. A fourth tooth is joined to the fourth spine. A fifth tooth is joined to the fifth spine. Engaging the hydraulic ram causes the first spine, the second spine, the third spine, and the fourth spine to extend away from the bucket.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
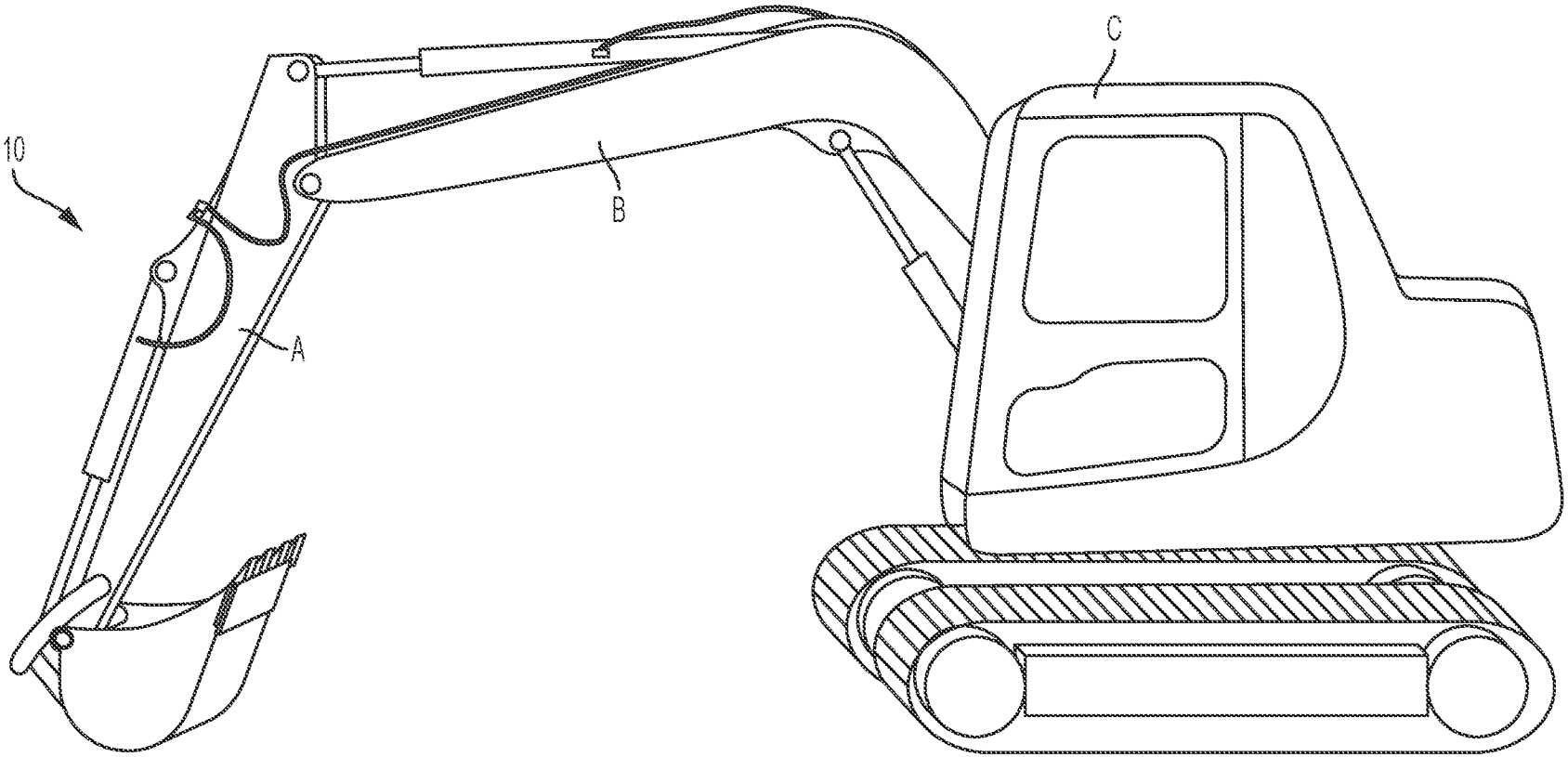
FIG. 1 shows a perspective view of one embodiment of the present invention shown in use.
Figure 2:
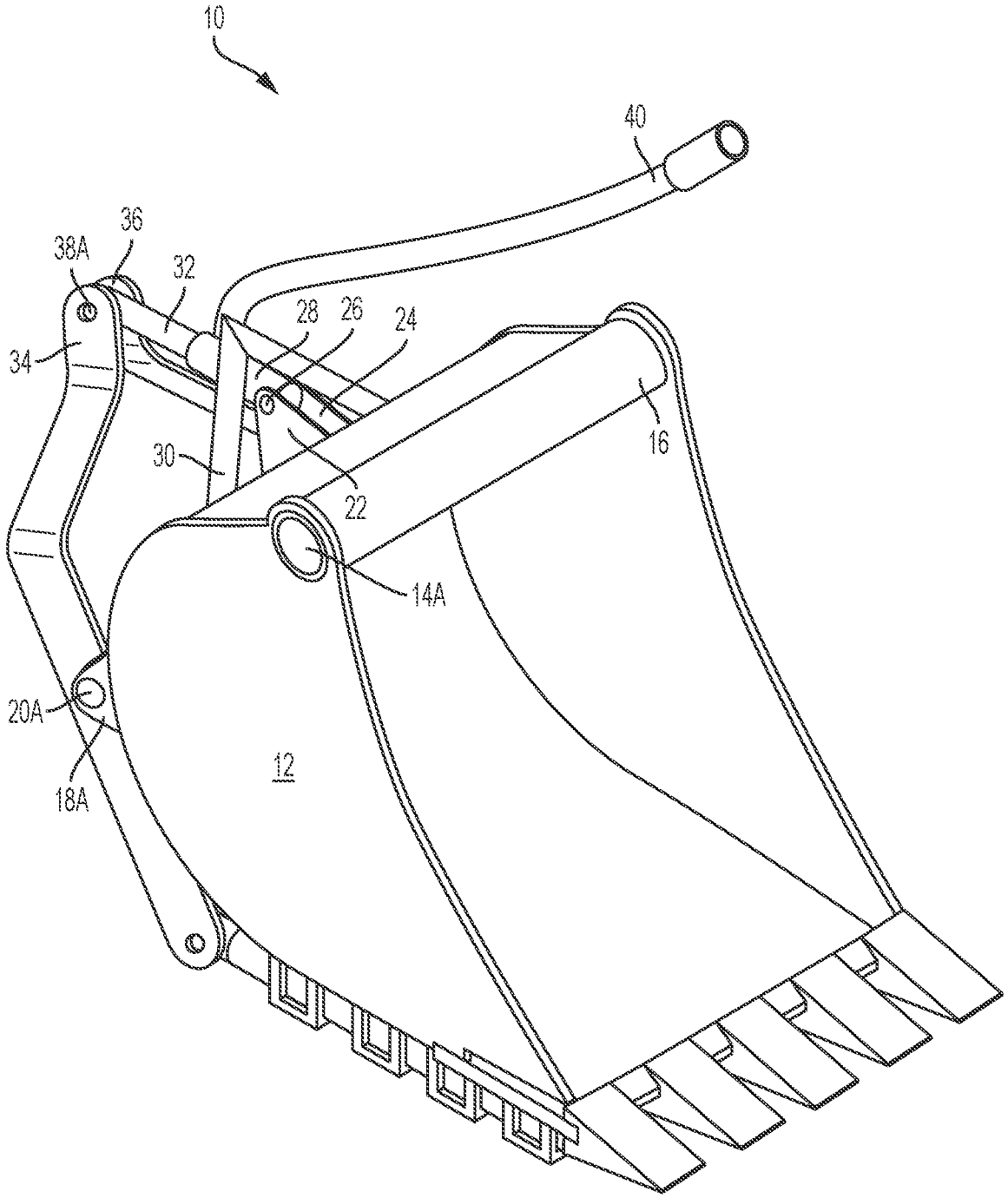
FIG. 2 shows a perspective view of one embodiment of the present invention.
Figure 3:
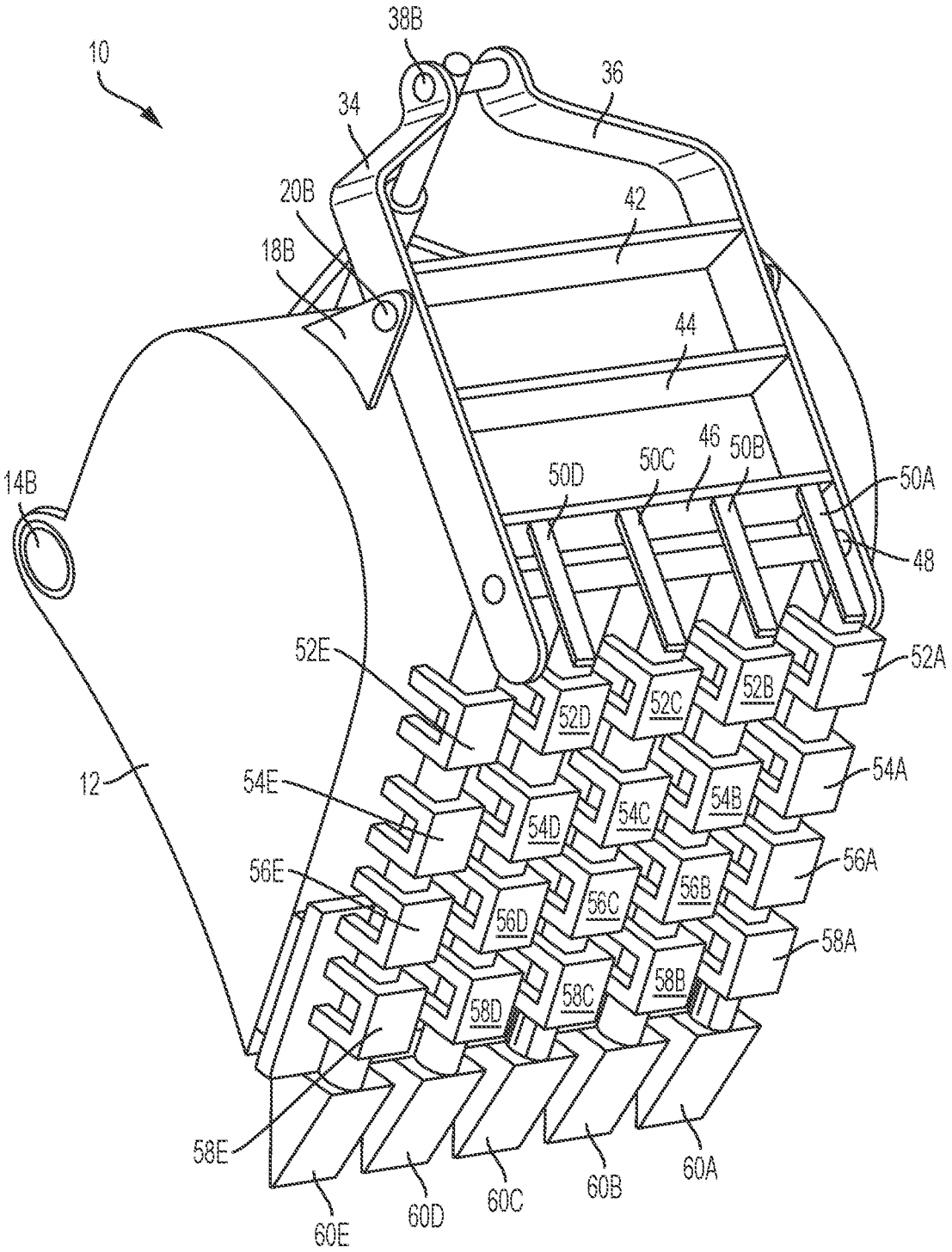
FIG. 3 shows a bottom perspective view of one embodiment of the present invention.
Figure 4:
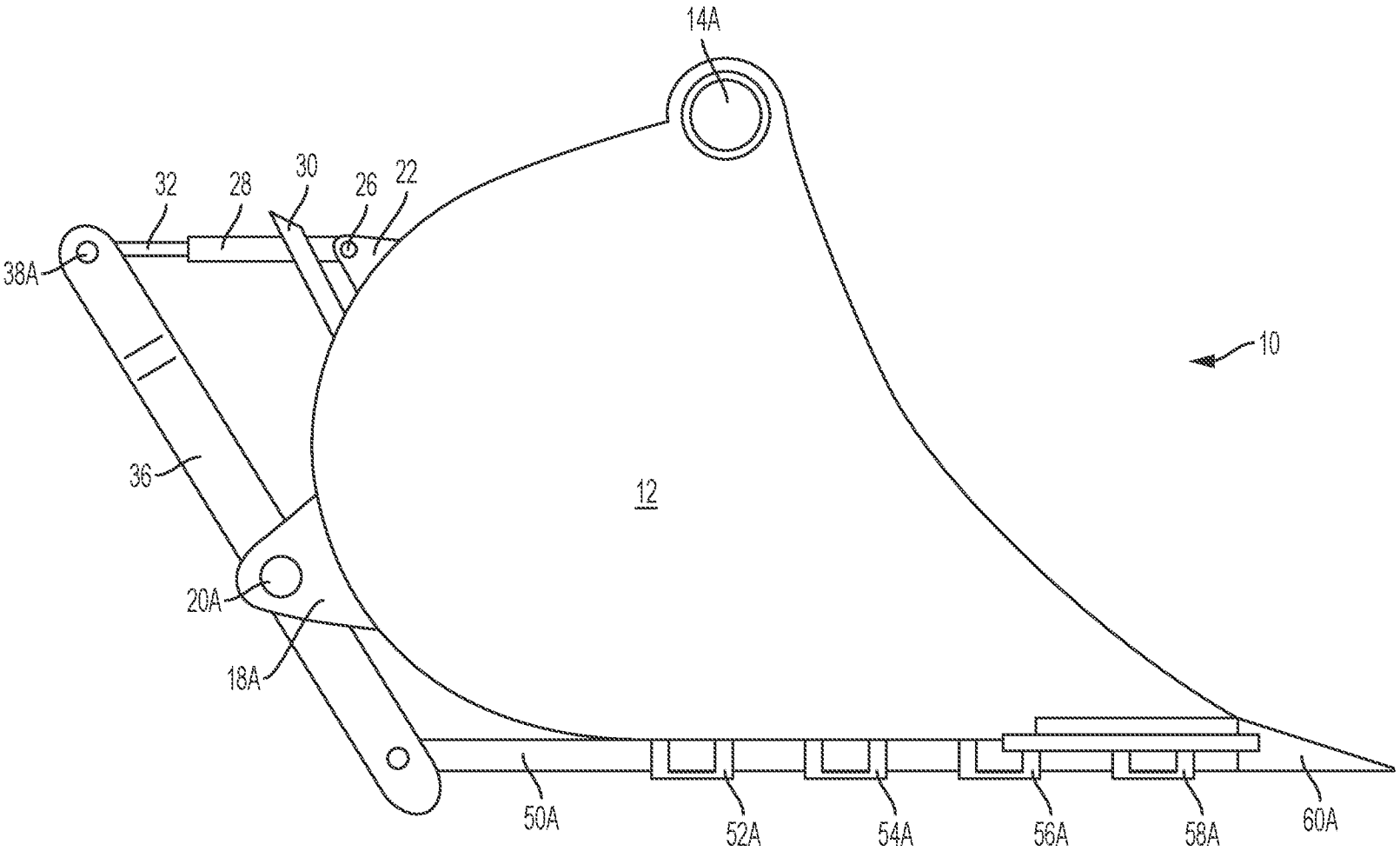
FIG. 4 shows a side view of one embodiment of the present invention.
Figure 5:
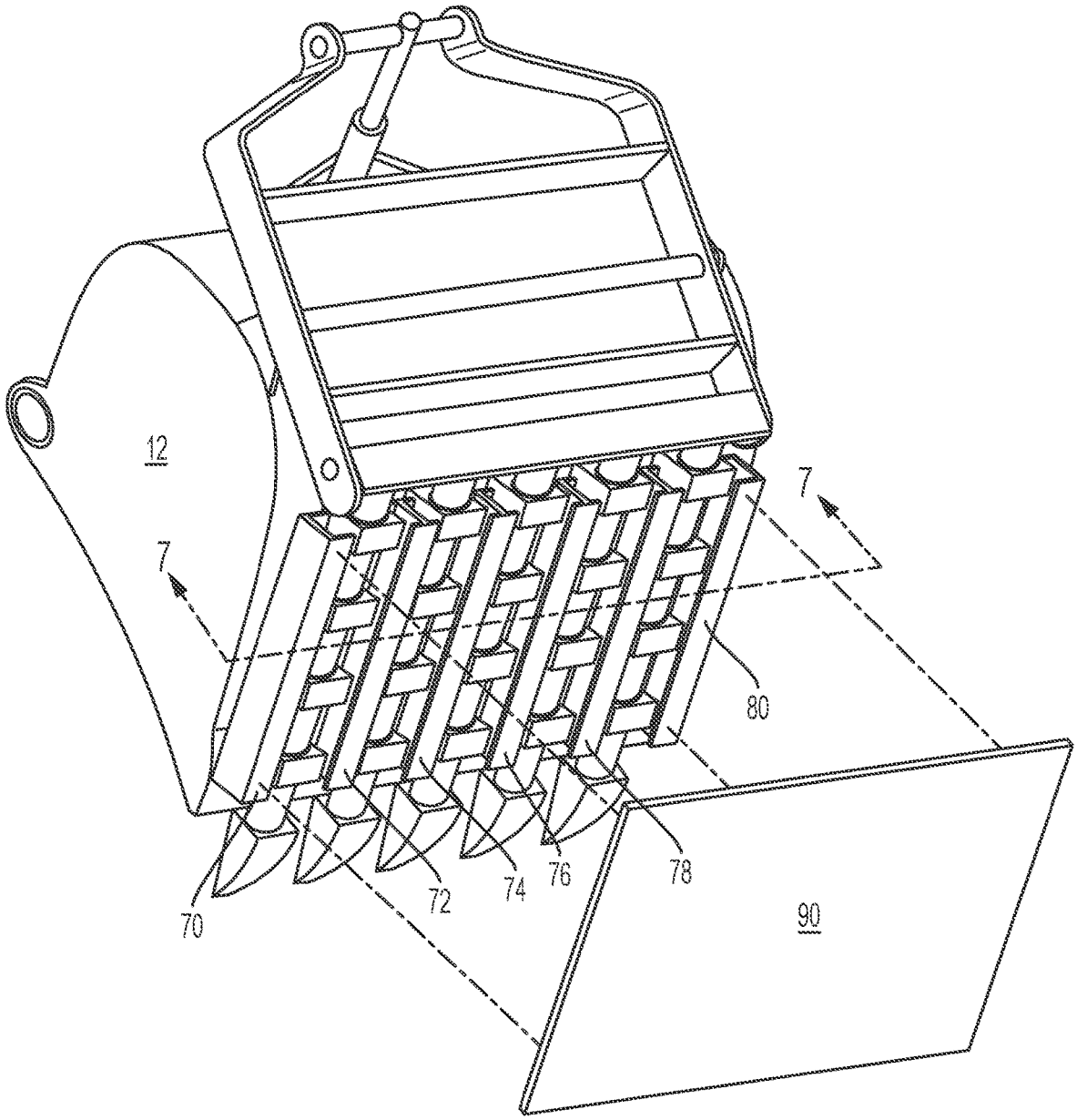
FIG. 5 shows a bottom assembly view of one embodiment of the present invention.
Figure 6:
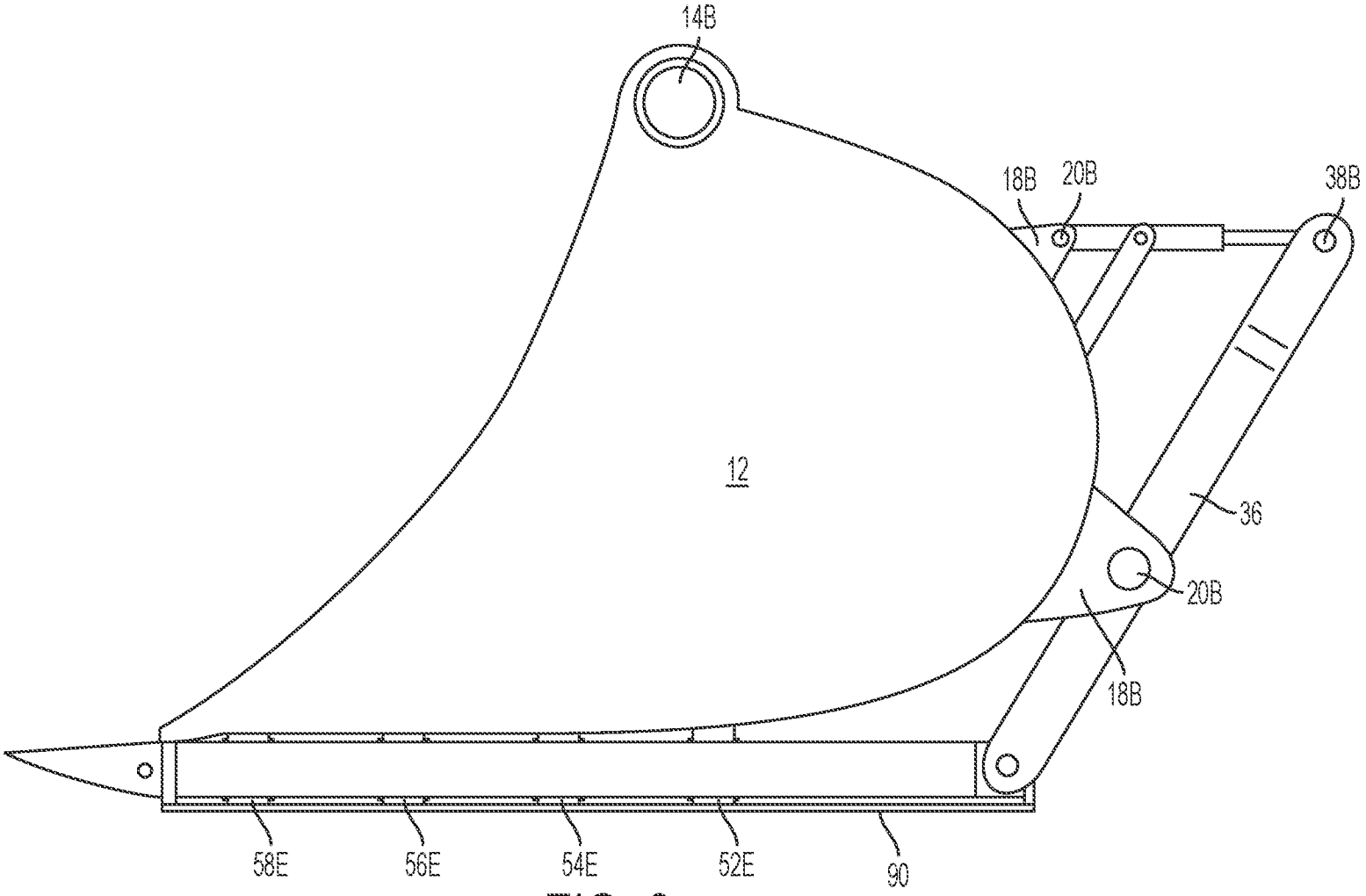
FIG. 6 shows a side view of one embodiment of the present invention.
Figure 7:
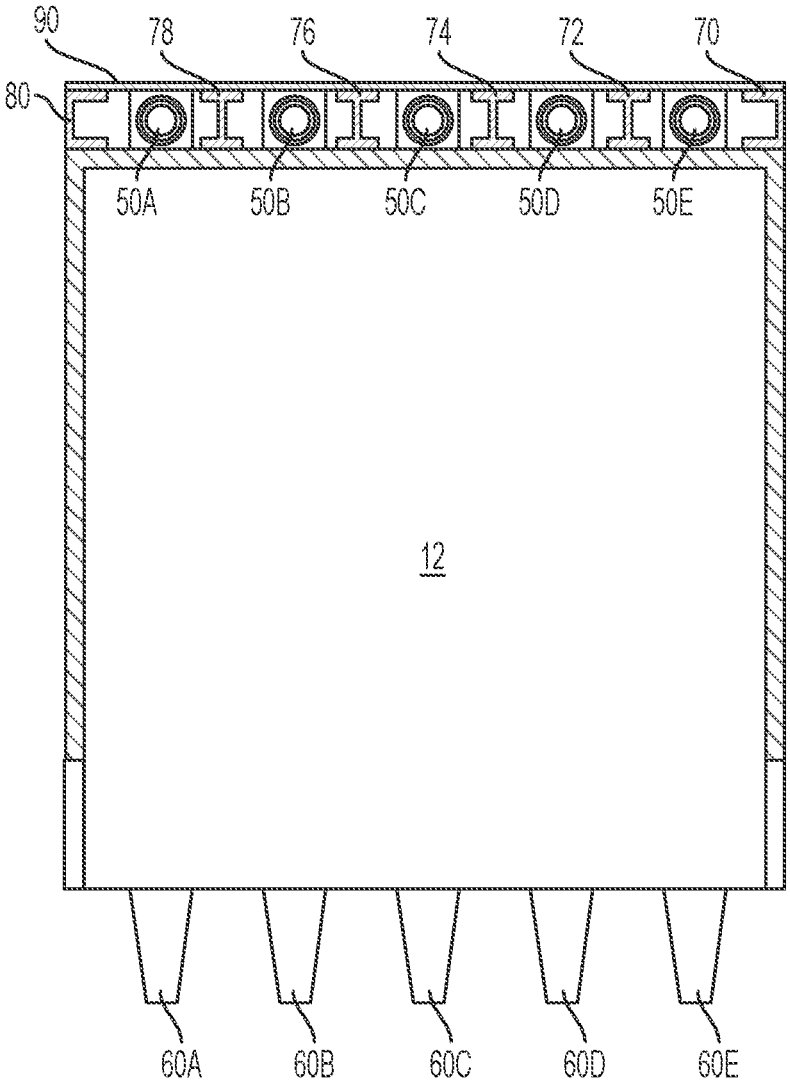
FIG. 7 shows a section view of one embodiment of the present invention taken along line 7-7 in FIG. 5.

By way of example, and referring to FIGS. 1-7, one embodiment of a retractable tooth bucket, configured to provide both digging and grading functionality on a worksite. A crane 10 further comprises a cab C which provides controls for a boom B joined to an arm A. The arm A is joined to a bucket 12. The retractable tooth bucket comprises a bucket 12, joined to a pin 16 with a first lock 14A and a second lock 14B. A first bracket 18A and a second bracket 18B are joined to the bucket 12. A first pivot frame 34 is joined to the first bracket 18A with a first pin 20A. A second pivot frame 36 is joined to the second bracket 18B with a second pin 20B. A first mounting bracket 22 is joined to the bucket 12. A second mounting bracket 24 is joined to the bucket 12.

A hydraulic ram 28 is joined to the first mounting bracket 22 and the second mounting bracket 24 with a hydraulic ram pin 26. A support bracket 30 is joined to the hydraulic ram 28 and configured to provide support for the hydraulic ram 28. A cylinder 32 is joined to the hydraulic ram 28, the first pivot frame 34, and the second pivot frame 36 with a pivot frame pin 38A secured by a fastener 38B. A hydraulic fluid line 40 is joined to the hydraulic ram 28 and to a quick connect. The hydraulic fluid line 40 is representative of both supply and return lines necessary to operate the hydraulic ram 28. A first cross member 42, a second cross member 44, and a third cross member 46, and a pivot pin 48 are joined to the first pivot frame 34 and the second pivot frame 36.

A first spine 50A, a second spine 50B, a third spine 50C and a fourth spine 50D are joined to the third cross member 46 and arranged against the pivot pin 48. A first tooth 60A is joined to the first spine 50A. A second tooth 60B is joined to the second spine 50B. A third tooth 60C is joined to the third spine 50C. A fourth tooth 60D is joined to the fourth spine 50D. A fifth tooth 60E is joined to the fifth spine 50E. Engaging the hydraulic ram 28 causes the first spine 50A, the second spine 50B, the third spine 50C and the fourth spine 50D extend away from the bucket 12. A first bracket pin joined to the first bracket.

A first tooth first sleeve 52A, a first tooth second sleeve 54A, a first tooth third sleeve 56A, and a first tooth fourth sleeve 58A are joined to the bucket 12 and partially covering the first spine 50A. A second tooth first sleeve 52B, a second tooth second sleeve 54B, a second tooth third sleeve 56B, and a second tooth fourth sleeve 58B are joined to the bucket 12 and partially covering the second spine 50B. A third tooth first sleeve 52C, a third tooth second sleeve 54C, a third tooth third sleeve 56C, and a third tooth fourth sleeve 58C are joined to the bucket 12 and partially covering the third spine 50C. A fourth tooth first sleeve 52D, a fourth tooth second sleeve 54D, a fourth tooth third sleeve 56D, and a fourth tooth fourth sleeve 58D are joined to the bucket 12 and partially covering the fourth spine 50D. A fifth tooth first sleeve 52E, a fifth tooth second sleeve 54E, a fifth tooth third sleeve 56E, and a fifth tooth fourth sleeve 58E is joined to the bucket 12 and partially covering the fifth spine 50E.

A first plate bracket 70, a second plate bracket 72, a third plate bracket 74, a fourth plate bracket 76, a fifth plate bracket 78, and a sixth plate bracket 80 are attached to the bucket 12. A plate 90 is attached to the first plate bracket 70, the second plate bracket 72, the third plate bracket 74, the fourth plate bracket 76, a fifth plate bracket 78, and a sixth plate bracket 80.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶ 6. In particular, any use of "step of" in the claims is not intended to invoke the provision of 35 U.S.C. §112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A retractable tooth bucket, configured to provide both digging and grading functionality on a worksite; the retractable tooth bucket comprising:

a bucket, joined to a pin with a first lock and a second lock;

a first bracket and a second bracket, joined to the bucket;

a first pivot frame, joined to the first bracket;

a second pivot frame, joined to the second bracket;

a first mounting bracket, joined to the bucket;

a second mounting bracket, joined to the bucket;

a hydraulic ram, joined to the first mounting bracket and the second mounting bracket with a hydraulic ram pin;

a support bracket, joined to the hydraulic ram and configured to provide support for the hydraulic ram;

a cylinder, joined to the hydraulic ram, the first pivot frame, and the second pivot frame with a pivot frame pin;

a hydraulic fluid line, joined to the hydraulic ram and to a quick connect;

a first cross member and a second cross member, and a third cross member, and a pivot pin, joined to the first pivot frame and the second pivot frame;

a first spine, a second spine, a third spine, a fourth spine, and a fifth spine joined to the third cross member and arranged against the pivot pin;

a first tooth, joined to the first spine;

a second tooth, joined to the second spine;

a third tooth, joined to the third spine;

a fourth tooth, joined to the fourth spine;

a fifth tooth, joined to the fifth spine;

wherein engaging the hydraulic ram causes the first spine, the second spine, the third spine, the fourth spine, and the fifth spine to extend away from the bucket.

2. The retractable tooth bucket of claim 1, further comprising a first bracket pin joined to the first bracket.

3. The retractable tooth bucket of claim 2, further comprising, a first tooth first sleeve, a first tooth second sleeve, a first tooth third sleeve, and a first tooth fourth sleeve, joined to the bucket and partially covering the first spine.

4. The retractable tooth bucket of claim 3, further comprising, a second tooth first sleeve, a second tooth second sleeve, a second tooth third sleeve, and a second tooth fourth sleeve, joined to the bucket and partially covering the second spine.

5. The retractable tooth bucket of claim 4, further comprising, a third tooth first sleeve, a third tooth second sleeve, a third tooth third sleeve, and a third tooth fourth sleeve, joined to the bucket and partially covering the third spine.

6. The retractable tooth bucket of claim 5, further comprising, a fourth tooth first sleeve, a fourth tooth second sleeve, a fourth tooth third sleeve, and a fourth tooth fourth sleeve, joined to the bucket and partially covering the fourth spine.

7. The retractable tooth bucket of claim 6, further comprising, a fifth tooth first sleeve, a fifth tooth second sleeve, a fifth tooth third sleeve, and a fifth tooth fourth sleeve, joined to the bucket and partially covering the fifth spine.

8. The retractable tooth bucket of claim 7, further comprising a first plate bracket, a second plate bracket, a third plate bracket, a fourth plate bracket, a fifth plate bracket, and a sixth plate bracket, attached to the bucket.

9. The retractable tooth bucket of claim 8, further comprising a plate, attached to the first plate bracket, the second plate bracket, the third plate bracket, the fourth plate bracket, the fifth plate bracket, and the sixth plate bracket.

* * * * *